United States Patent [19]

Russell et al.

[11] 4,325,207

[45] Apr. 20, 1982

[54] ARCH FORMING ASSEMBLY

[75] Inventors: Leslie T. Russell, Halifax; George M. Proctor, Cornwall; William H. Bowes, Ottawa, all of Canada

[73] Assignee: Canadian Patents & Development Ltd., Ottawa, Canada

[21] Appl. No.: 146,358

[22] Filed: May 2, 1980

Related U.S. Application Data

[63] Continuation-in-part of Ser. No. 21,333, Mar. 19, 1979, abandoned.

[30] Foreign Application Priority Data

Apr. 25, 1978 [CA] Canada ..... 301939

[51] Int. Cl.[3] ..... E04B 1/32; E04C 3/46

[52] U.S. Cl. ..... 52/641; 52/64; 52/86; 52/645; 249/24; 249/209

[58] Field of Search ..... 52/86, 64, 641, 645; 249/24, 179, 189, 209

[56] References Cited

U.S. PATENT DOCUMENTS

| | | | |
|---|---|---|---|
| 1,940,033 | 6/1933 | Miller | 249/24 |
| 2,995,797 | 8/1961 | Hoffmann | 249/189 |
| 3,057,119 | 10/1962 | Kessler | 52/63 X |
| 3,530,622 | 9/1970 | Cohen | 52/86 |
| 3,849,953 | 11/1974 | Cohen | 52/71 X |
| 3,897,622 | 8/1975 | Utahara | 52/86 |
| 3,973,370 | 8/1976 | McAllister | 52/86 |

FOREIGN PATENT DOCUMENTS

| | | | |
|---|---|---|---|
| 222377 | 7/1959 | Australia | 52/86 |
| 1202706 | 8/1970 | United Kingdom . | |

*Primary Examiner*—Alfred C. Perham
*Attorney, Agent, or Firm*—Francis W. Lemon

[57] ABSTRACT

A collapsible arch forming assembly comprising a flexible member and two tension line lengths with one tension line length threaded through even number guides, counted from one end of the flexible member and the other tension line length threaded through the odd number guides. Tensioning the tension line lengths arches the flexible member into the arch and this may be done by a winch assembly or inserting spreader bars at the guides to deflect the free one of the first and second tension line lengths at that position. The spreader bars may be replaced by, for example, mechanical jacks or fluid pressure actuated jacks particularly for such applications as using the arch forming assembly as formwork upon which concrete is poured.

6 Claims, 13 Drawing Figures

ARCH FORMING ASSEMBLY

Figure 1:
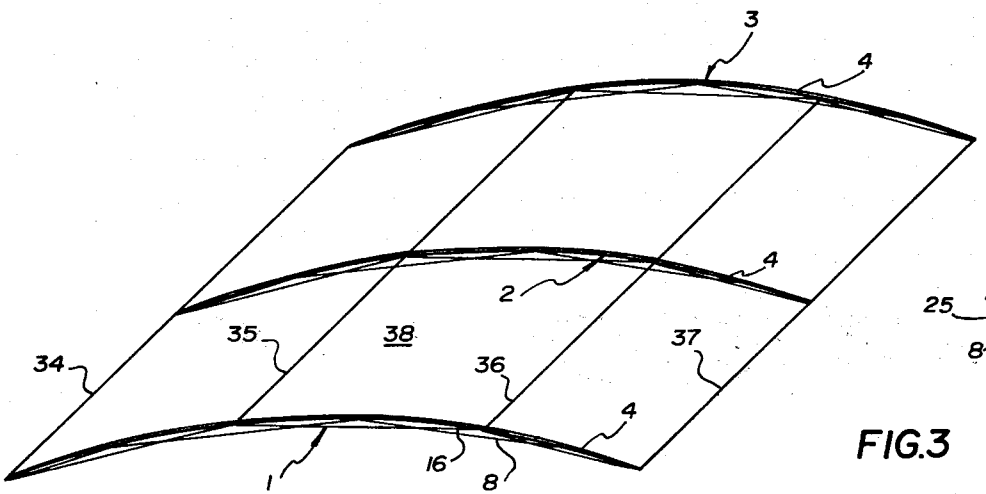

This is a continuation-in-part application of application Ser. No. 21,333 filed Mar. 19, 1979, now abandoned.

This invention relates to an arch forming assembly.

United Kingdom Pat. No. 1,202,706, dated June 14, 1968, "Arched Building Members", E. J. Cohen, discloses a building assembly comprising an elongated building member with flexible tensioning member connected thereto at spaced positions therealong and in spaced relationship therefrom so that on applying a tension to the flexible tensioning member the building member is cambered upwardly and thereby erected.

While the arched building member devised by E. J. Cohen has no doubt been found to be useful in some areas it has been found by the applicants to have a drawback in that the elongated building member can only be cambered to a limited extent and so the arched building member cannot be used where a building having a reasonable degree of internal height is required.

In U.S. Pat. No. 3,849,953, dated Nov. 26, 1974, "Arched Building Assembly Formed of Resiliently, Flexible Members", E. J. Cohen, discloses an improvement on the arched building member, comprising a building assembly for erecting an arched, resiliently flexible building member in which the building member consists of two sub-members which are interconnected by a resiliently flexible connector capable of greater flexure than the sub-members so that, on erection, the building member has an upwardly pointed shape. Flexure of the flexible connector, and upward cambering of the sub-members is effected by loading the sub-members in compression with loading cables which interconnect longitudinally spaced parts of the building member and are raised with the building member by bracing means which maintain the cables in fixed spaced relationship to intermediate parts of the building member. Flexure in both the resiliently flexible connected and the sub-members occurs simultaneously, but to a greater extent in the resilient member. Additional loading cables may be provided for flexing the sub-members independently.

While the arched building assembly of Cohen does increase the internal height of the building by most of the deflection occurring in the resiliently flexible connector there is still a problem in that the arched building assembly, when erected, assumes the form of a slightly cambered, splayed, inverted V-shape and so additional height is only provided at the center of the building.

Thus there is still a need for an arch forming assembly which provides adequate internal height over a reasonable portion of the building floor space.

According to the present invention there is provided an arch forming assembly, comprising:

(a) a substantially flat flexible member for bending to the shape of the curved arch, (b) a plurality of tension line guides attached to the flexible member at spaced intervals to a side of the flexible member which will define the inside of the arch so that tension line guides will be spaced therearound, (c) a first tension line attached at one end to a first side portion of the flexible member and threaded through even number tension line guides only, counted from the said first side portion to a second side portion opposed thereto, and attached at the other end to the second side portion, (d) a second tension line attached at one end to the first side portion of the flexible member and threaded through odd number tension line guides only, counted from the said first side portion towards the said second side portion, and attached at the other end to the said second side portion, and (e) means for tensioning the said first and second tension lines to bend the flexible member to the shape of the curved arch.

Figure 3:
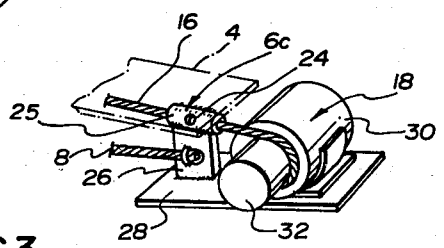
Figure 5:
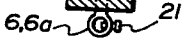
Figure 2:
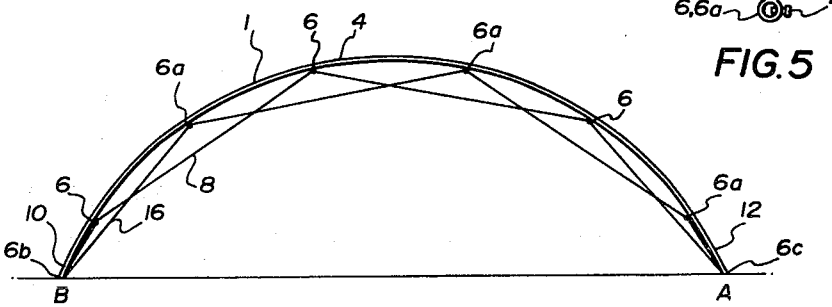
Figure 4:
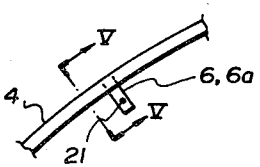
Figure 6:
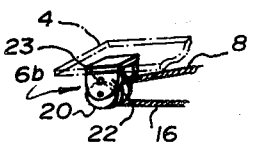
Figure 9:
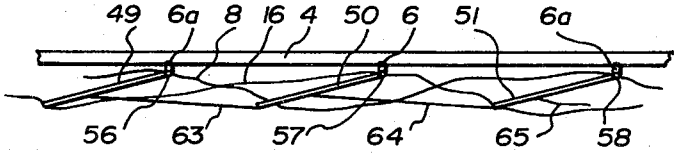
Figure 7:
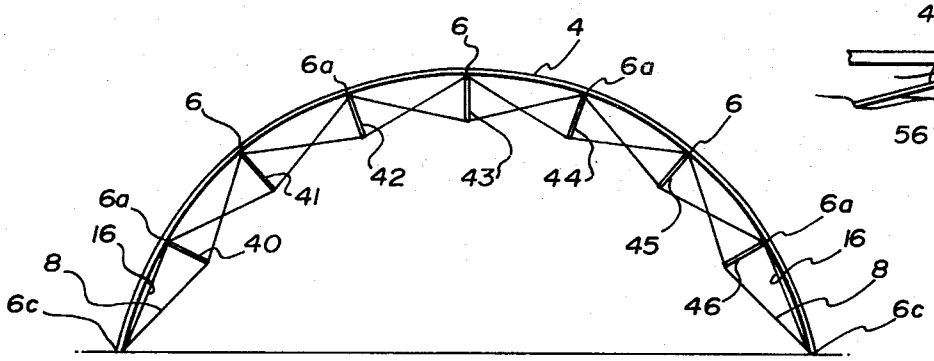
Figure 10:
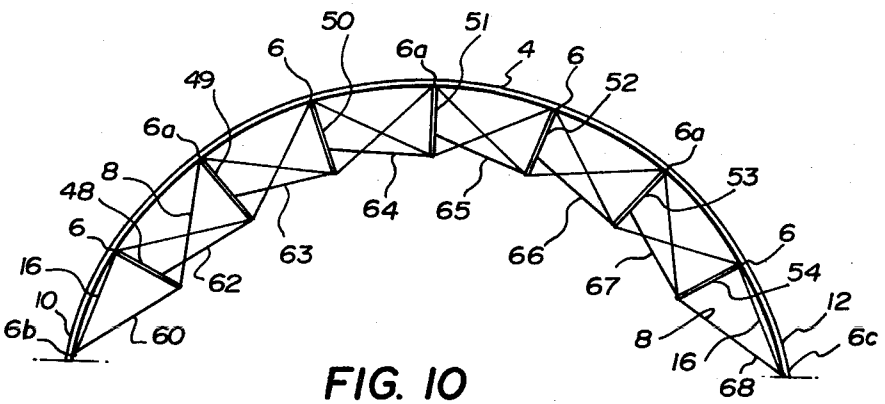
Figure 8:
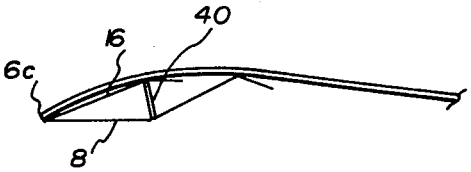
Figure 11:
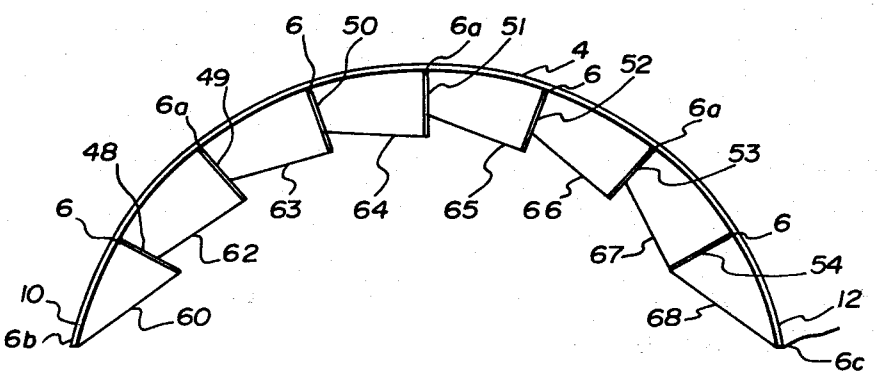
Figure 12:
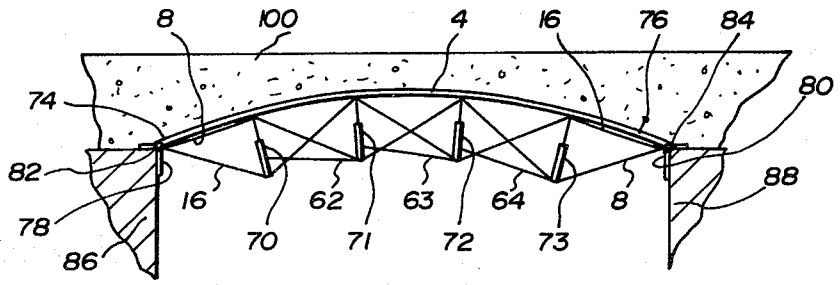
Figure 13:
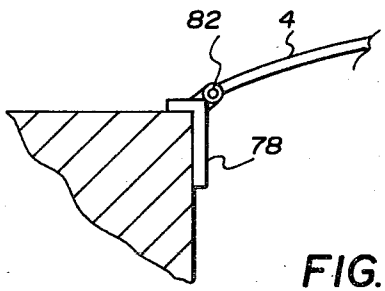

In the accompanying drawings which illustrate, by way of example, embodiments of the present invention, FIG. 1 is an isometric view of an arch forming assembly in a collapsed form, FIG. 2 is an end view of the arch forming assembly, shown in FIG. 1, erected, FIG. 3 is an enlarged perspective view of a means for tensioning first and second tension lines shown in FIGS. 1 and 2, at the right hand end of a flexible member, FIG. 4 is a side view of a tension line guide and a portion of a flexible member, FIG. 5 is a sectional end view of FIG. 4 along V—V, FIG. 6 is an enlarged perspective view of the first and second tension lines shown in FIGS. 1 and 2, joined at the left hand end of the flexible member and passing around a pulley at the joint, FIG. 7 is an end view of a different arch forming assembly to that shown in FIGS. 1 and 6, FIG. 8 is an end view of a portion of the arch forming assembly shown in FIG. 7, FIG. 9 is an end view of a portion of a different arch forming assembly to that shown in any of FIGS. 1 to 6, in a collapsed condition, FIG. 10 is an end view of the arch forming assembly shown in FIG. 9, in an erected condition, FIG. 11 is a similar end view to that shown in FIG. 10 with the tension line lengths omitted, FIG. 12 is a similar end view to that shown in FIG. 10 with the arch forming assembly being used as a formwork for concrete, and FIG. 13 is an end view of a corner support for the arch forming assembly shown in FIG. 12.

Referring to FIGS. 1 to 6, there are shown three arch forming assemblies 1 to 3, each comprising:

(a) a substantially flat flexible member 4 for bending to the shape of the curved arch shown in FIG. 2, (b) a plurality of tension line guides 6, *6a*, *6b* and *6c*, shown in detail in FIGS. 3 to 6, attached to the flexible member 4 at spaced intervals on a side of the flexible member 4 which will form the inside of the arch so that tension line guides 6, *6a*, *6b* and *6c* will be spaced therearound, (c) a first tension line 8 attached at one end to a first side portion 10 of the flexible member 4, by means of tension line guide *6b*, and threaded through even number tension line guides 6 only, counted from the said first side portion 10 towards a second side portion 12 opposed thereto, and attached at the other end to the second side portion 12, in this embodiment by means of tension line guide *6c*, (d) a second tension line 16 attached, in this embodiment by means of tension line guide *6b*, to the first side portion 10 of the flexible member 4 and threaded through odd number tension line guides 6 only, counted from the said first side portion 10 towards the said second side portion 12, and attached at the other end to the said second side portion 12, in this embodiment by means of tension line guide *6c*, and (e) means generally designated 18 in FIG. 3 for tensioning the said first and second tension lines 8 and 16 to bend the flexible member 4 (shown chain-dotted in FIGS. 3 and 6) to the shape of the curved arch.

The tension lines 8 and 16 in this embodiment are helically stranded steel cables and are in one continuous length which is attached to the first side portion 10 by looping around a freely rotatable pulley 20 (FIG. 6) of the tension line guide 6*b*. The tension line guide 6*b* comprises the pulley 20 mounted to freely rotate in a bracket 22 securely attached to an end portion of the flexible member 4 and a set screw 23 for locking the first and second tension lines 8 and 16 to the bracket 22. In other embodiments, the tension line guide 6*b* comprises an eye bolt of the type shown in FIGS. 4 and 5, attached to the flexible member 4 in a secure manner.

The tension line guides 6 and 6*a* (FIGS. 4 and 5) each comprise an eye bolt, preferably provided with a set screw 21 or other locking device for clamping the tension line 8 or 16 against slipping therethrough once the flexible member 4 has assumed the shape of a curved arch.

The tension line guide 6*c* (FIG. 3) comprises a tube 25 which is attached to the flexible member 4 and has a set screw 24 or other locking device for clamping the tension line 16 in the same manner as the set screw 21 (FIGS. 4 and 5). Tension line guide 6*c* has a bracket plate 26 welded thereto. The end of the tension line 8 is secured to the bracket plate 26. The bracket plate 26 is welded to a base plate 28 upon which is mounted a variable speed electric motor and slipping clutch gear reduction unit 30 having a winch drum 32 mounted on its driving shaft. The end of the tension line 16 is attached to a winch drum 32.

The flexible members 4 of each of the arch forming assemblies 1 to 3 are joined by transverse members 34 to 37 to form one structure, and a flexible covering sheet or roof covering 38 of, for example, a synthetic plastic material is preferably placed over and tied to the structure when it is in the flattened condition shown in FIG. 1.

The structural member 4 may be integral with the roof covering 38 where the entire unit is constructed from fibreglass or other suitable material. On erection, sections of the building complete with structural member and roof covering are raised in position. The erected sections can then be sealed at the joining points to provide a continuous leak-proof building. Longitudinal members, although fewer in number, could be provided to establish longitudinal integrity.

In operation the flexible members 4 have or are given a slight curvature in the direction in which they are to be arched while lying on the ground or a foundation. The members 4, if not provided with a slight curvature can be deflected to have one by providing support blocks or jacks underneath the members 4 before the flexible covering sheet 38 is placed over and tied to the structure.

Each electric motor and slipping clutch gear reduction unit 30 of each of the three arch forming assemblies are simultaneously driven to tension the first and second tension lines 8 and 16, until the flexible members 4 have been deflected to form an arch as shown in FIG. 2. When the flexible member 4 has been deflected to form the desired arch as shown in FIG. 2 each set screw 21 and 24 is tightened to lock the first and second tension lines 8 and 16 to each tension line guide 6, 6*a*, and 6*c*, and the set screw 23 is tightened to lock the first and second tension lines 8 and 16 to the bracket 22. Locking the first and second tension lines 8 and 16 in this manner is preferred because it provides the erected structure with additional strength and rigidity.

When it is necessary to collapse the arch forming assemblies 1 to 3 the set screws 21, 23 and 24 are unscrewed and the slipping clutch of the electric motor and slipping clutch unit 30 is used to gently collapse each flexible member 4.

The flexible members 4 may be stressed within the elastic limit for re-usable structures or beyond the elastic limit for permanent or semi-permanent structures.

The form of arch obtained depends on the spacings between the tension line guides 6, 6*a*, 6*b* and 6*c*. If the spacings between the tension guides 6 and 6*a* at a central portion of each flexible member 4 are enlarged or made smaller than the spacings of the remainder, then the local curvature at this central portion is either increased or decreased thus permitting a modified shape resulting in either greater head room and a shorter span or smaller head room and a larger span.

In different embodiments of the present invention the tension line guides 6, 6*a*, 6*b* and 6*c* are distributed along only a portion of the length of each flexible member 4 so that in the erected position each flexible member 4 has, for example, portions at each end that have not been deflected. These portions may have greater stiffness than the portions that are deflected or may be stiffened after the structure has been erected.

Further rigidity may be obtained by moving the lower ends of the flexible members 4 a little further apart once the first and second tension line lengths 8 and 16 have been clamped to the tension line guides 6, 6*a*, 6*b* and 6*c*.

If desired additional aid can be provided in the erection stage by drawing the ends of the flexible members together by, for example, an additional cable extending directly between these ends. This will reduce the load required in the first and second tension lines to deflect the flexible members 4.

In different embodiments of the present invention, the first and second tension line lengths 8 and 16 have their left hand ends secured to the flexible member 4 instead of being joined and passed around pulley 20. In this embodiment the right hand ends of both the first and second tension line lengths 8 and 16 are tensioned by, for example, a winch mechanism such as a drum actuated with a lever through a pawl or ratchet mechanism to prevent slipping. The pawl or ratchet device is preferably attached to the flexible member 4 making the whole assembly self-contained.

The embodiment shown in FIGS. 1 to 6 is particularly suitable for small buildings such as, for example, small home-style greenhouses and portable or temporary enclosures.

In FIGS. 7 and 8 similar parts to those shown in FIGS. 1 to 6 are designated by the same reference numerals.

In FIGS. 7 and 8 the first and second tension lines 8 and 16 are secured to the flexible member 4 at tension line guide 6*c* and pass through the tension line guides 6, 6*a* (FIGS. 4 and 5) and 6*c* (FIG. 3) and are secured therein by the set screws 24. In this embodiment the tensioning means 18 is not provided. The left hand ends of the tension line lengths 8 and 16 are secured to the flexible member 4.

The flexible member 4 is initially flat and is erected by progressively inserting spreader bars 40 to 46, starting with the spreader bar 40, as shown in FIG. 6 at the positions of the intermediate tension line guides 6 and 6a to deflect the tension line length 8 or 16 not passing therethrough. Thus the flexible member 4 is progressively deflected from the tension line lengths 8 and 16 to form an arch. The tension line lengths 8 and 16 are then locked in the tension line guides 6 and 6a by set screws or other locking devices. The spreader bars 40 may also be secured to the tension line lengths 8 and 16 to provide additional rigidity to the structure. The degree of curvature imparted to the flexible member 4 depends on the lengths of the spreader bars 40 to 46 which may be different to produce an arch of a particular shape.

As with the previous embodiment the ends of the flexible member 4 may be drawn closer by, say, a cable extending across the gap between them to assist in this instance in the installation of the spreader bars 40 to 46.

Further, as with the previous embodiment, further rigidity may be obtained by moving the lower ends of the flexible member 4 a little further apart following the clamping of the tension line lengths 8 and 16 at the tension line guides 6 and 6a.

The flexible member 4 may be deformed within the elastic limit or may be deformed beyond the elastic limit in which case it will be capable of carrying a greater load.

In FIGS. 9 to 11, similar parts to those shown in FIGS. 1 to 6 are designated by the same reference numerals and the previous description is relied upon to describe them.

In FIGS. 9 to 11 the spreader bars 48 to 54 are pivotally attached at one end to the intermediate tension line guides 6 and 6a by hinges 56 to 58 shown in FIG. 9, and have slots at the other ends through which the tension line lengths 8 and 16 are held captive in a freely slidable manner. In this embodiment the tension line lengths 8 and 16 are each anchored at both ends to the flexible member 4 and are secured to the tension line guides 6 and 6a by, for example, set screws (not shown) when the flexible member 4 has been deflected to form an arch.

The spreader bar 48 closest to the first side portion 10 is attached thereto by an anchor string cable 60 and each spreader bar 49 to 54 subsequently to the spreader bar 48 in the direction of the second side portion 12 is secured to the preceding spreader bar by one of the draw string cables 62 to 67. The spreader bar 54 which is closest to the second side portion 12 has a draw string cable 68 attached thereto which is threaded through the tube 25 of the tension line guide 6c and is attached to the means generally designated 18 for tensioning the first and second tension lines 8 and 16, which is preferably a ratchet operated device.

In operation the draw string cable 68 is tensioned to draw the spreader bars 48 to 54 from the position shown in FIG. 9 to the position shown in FIGS. 10 and 11 where further movement of the spreader bars is prevented by the anchor string cable 60 and the draw string cables 62 to 67. This movement of the spreader bars tensions the first and second tension lines 8 and 16 which causes the flexible member 4 to be deflected to the desired arch. The draw string cable 68 is then clamped in the tube 25 (FIG. 3) by means of the set screw 24 or other locking device.

The lengths of the anchor string cable 60 and each draw string cable 62 to 67 are chosen bearing in mind that for good structural design:

(i) they control the angles between the flexible member 4 when deflected and the spreader bars 49 to 54 which are preferably such that the spreader bars 49 to 54 extend substantially radially inwards from the curvature of the arch, and (ii) preferably the length of each draw string cable 62 to 67 equals the arcuate length of the deflected portion of the flexible member 4 between the two spreader bars connected by that draw string cable. This may also determine the position along each spreader bar 49 to 54 that the left hand end of a draw string cable is connected thereto.

The embodiment shown in FIGS. 9 to 11 is particularly suitable for use in large, demountable buildings, semi-permanent and permanent buildings and as formwork for reinforced concrete where curved formwork is required, e.g. arches, domes and etc.

In FIGS. 12 and 13 similar parts to those shown in FIGS. 9 to 11 are designated by the same reference numerals and the previous description is relied upon to describe them.

In FIGS. 12 and 13 the spreader bars may be actuated by anchor string cables as described with reference to FIGS. 9 to 11 or in the form of fluid pressure actuated jacks 70 to 73. When fluid pressure actuated jacks 70 to 73 are used, they are secured to the flexible member in such a manner that they remain normal thereto at all times. Anchor string cables are not necessary with fluid pressure actuated jacks 70 to 73 and the first and second tension line lengths 8 and 16 are secured to the free ends thereof in a freely slidable manner. The tension line lengths 8 and 16 are each secured at both ends 74 and 76 to the flexible member 4. The ends 74 and 76 of the flexible member 4 are provided with angle supports 78 and 80 respectively which are pivotally attached to the flexible member 4 by release pins 82 and 84 respectively.

In operation the jacks 70 to 73 are actuated to cause the flexible member 4 to assume the arch without being coupled to the angle supports 78 and 80. The angle supports 78 and 80 are placed upon supports 86 and 88 which the formed concrete 100 is to span and the flexible member 4 is coupled to the angle supports 78 and 80 by the pins 82 and 84 respectively. The concrete is then poured and allowed to harden to form the concrete 100.

The structure is then released from the concrete by first temporarily supporting the form, then removing the pins 82 and 84, and then actuating at least one of the jacks or increasing the curvature by any other means hence causing the ends 82 and 84 to move away from the concrete 100 and thus breaking the bond between the formwork and the concrete. The form is then removed from underneath the concrete 100 for use elsewhere.

In other embodiments of the present invention, where the width of the flexible member 4 permits it, one pair of tension line lengths 8 and 16 extend along one diagonal path across the flexible member 4 while another pair of tension line lengths 8 and 16 extend along the other diagonal path across the flexible member 4, and the flexible member 4 can either be given an extra curvature in a width wise direction or be stiffened to avoid this at least along the edges.

In some embodiments of the present invention the first and second tension line lengths 8 and 16 comprise a single wire strand of steel or another metal, a plastic filament or cord of, for example, superpolyamide.

We claim:

1. An arch forming assembly, comprising:

(a) a substantially flat flexible member for bending to the shape of the curved arch, (b) a plurality of tension line guides attached to the flexible member at spaced intervals to a side of the flexible member which will define the inside of the arch so that tension line guides will be spaced therearound, (c) a first tension line attached at one end to a first side portion of the flexible member and threaded through even number tension line guides only, counted from the said first side portion to a second side portion opposed thereto, and attached at the other end to the second side portion, (d) a second tension line attached at one end to the first side portion 10 of the flexible member and threaded through odd number tension line guides only, counted from the said first side portion towards the said second side portion, and attached at the other end to the said second side portion, and (e) means for tensioning the said first and second tension lines to bend the flexible member to the shape of the curved arch.

2. An assembly according to claim 1, wherein the said first and second tension lines comprise lengthwise portions of a continuous tension line that is looped through a tension line guide attached to the second side portion.

3. An assembly according to claim 1, wherein the means for tensioning the said first and second tension lines comprises a winch mechanism.

4. An assembly according to claim 1, wherein the means for tensioning the said first and second tension lines comprises spreader bars inserted at the positions of the intermediate tension line guides to deflect the one of the first and second tension lines not threaded through that particular tension line guide.

5. An assembly according to claim 1, wherein the means for tensioning the said first and second tension lines comprises spreader bars each pivotally attached at one end to one of the intermediate tension line guides and having the free one of the first and second tension lines held captive at the other end in a freely slidable manner, an anchor string is secured at one end to the said first side portion of the flexible member and at the other end to a first of the spreader bars to prevent the first spreader bar from assuming other than a substantially radially inwardly extending position when the flexible member is arched, draw strings securing each spreader bar from the first spreader bar to the preceding spreader bar to limit movement of that spreader bar to the said substantially radially inwardly extending position, and a draw-string cable attaching the last of the spreader bars to the means for tensioning the said first and second tension lines, whereby the said means will tension the final draw-string cable to pull the spreader bars to the said radially inwardly extending positions thereby tensioning the first and second tension lines and arching the flexible member.

6. An assembly according to claim 1, wherein the said means for tensioning the first and second tension lines comprises fluid pressure actuated jacks at the positions of the intermediate tension line guides and extending normal to the flexible member with the free one of the first and second tension lines at that position secured to the free end of that jack in a freely slidable manner.

* * * * *